US008104445B2

(12) United States Patent
Seeger

(10) Patent No.: US 8,104,445 B2
(45) Date of Patent: Jan. 31, 2012

(54) SPARK PLUG AND CYLINDER HEAD

(75) Inventor: Peter Seeger, Bensheim (DE)

(73) Assignee: GM Global Technology Operations LLC, Detroit, MI (US)

( * ) Notice: Subject to any disclaimer, the term of this patent is extended or adjusted under 35 U.S.C. 154(b) by 596 days.

(21) Appl. No.: 12/129,192

(22) Filed: May 29, 2008

(65) Prior Publication Data

US 2008/0295792 A1 Dec. 4, 2008

(30) Foreign Application Priority Data

May 29, 2007 (DE) ..... 10 2007 024 878

(51) Int. Cl.
*H01T 13/26* (2006.01)
*H01T 13/20* (2006.01)

(52) U.S. Cl. ..... 123/169 EA; 123/169 E; 313/125; 313/141

(58) Field of Classification Search ..... 123/169 R, 123/169 CA, 169 CB, 169 EL, 169 RA, 169 EB, 123/169 EC, 169 PA, 169 PH, 298, 299, 123/305, 260; 313/125, 136, 137, 141, 44, 313/145.1

See application file for complete search history.

(56) References Cited

U.S. PATENT DOCUMENTS

| | | | | |
|---|---|---|---|---|
| 2,233,660 | A * | 3/1941 | Barnes | 313/141 |
| 2,616,406 | A * | 11/1952 | Thomas | 313/125 |
| 3,257,503 | A * | 6/1966 | Lentz et al. | 313/144 |
| 4,059,079 | A * | 11/1977 | Kasima et al. | 123/260 |
| 4,967,708 | A | 11/1990 | Linder et al. | |
| 4,989,557 | A | 2/1991 | Penney | |
| 6,170,458 | B1 | 1/2001 | Miller | |
| 6,644,267 | B2 * | 11/2003 | Wuerfel | 123/298 |
| 6,659,070 | B2 * | 12/2003 | Sebastian et al. | 123/298 |

FOREIGN PATENT DOCUMENTS

| | | | |
|---|---|---|---|
| DE | 3731211 | A1 | 3/1989 |
| DE | 69100033 | T2 | 6/1993 |
| DE | 19855791 | A1 | 6/2000 |
| DE | 10155404 | A1 | 5/2003 |
| DE | 10349077 | A1 | 5/2005 |
| DE | 69922366 | T2 | 12/2005 |
| DE | 102009034538 | A1 | 1/2011 |
| EP | 1059714 | A1 | 12/2000 |

* cited by examiner

*Primary Examiner* — Willis Wolfe, Jr.
(74) *Attorney, Agent, or Firm* — Ingrassia Fisher & Lorenz, P.C.

(57) ABSTRACT

A spark plug comprises a spark plug body, which carries two electrodes bordering a spark gap at one end, and exhibits a nut with external thread that can rotate around the spark plug body. A cylinder head exhibits a rotational coding complementary to the rotational coding of the spark plug body.

10 Claims, 1 Drawing Sheet

SPARK PLUG AND CYLINDER HEAD

CROSS-REFERENCE TO RELATED APPLICATION

This application claims priority to German Patent Application No. 102007024878.6, filed May 29, 2007, which is incorporated herein by reference in its entirety.

TECHNICAL FIELD

The present invention relates to a spark plug and cylinder head for an internal combustion engine, in which the spark plug can be used.

BACKGROUND

Conventional spark plugs for spark ignition engines have a long stretched-out spark plug body, in which a central section carries an external thread, and one end has two electrodes bordering a spark gap. As a rule, one of these electrodes is arranged on a longitudinal axis of the spark plug body, and can be exposed to a high voltage, while the other electrode is a ground electrode that extends like a hook from the spark plug body and around the high-voltage electrode. Both electrodes combined define a spark gap lying on the axis of the spark plug body.

When such a conventional spark plug is screwed into a cylinder head, the rotational orientation assumed by the completely mounted spark plug is absolutely random. In internal combustion engines with homogeneous combustion, spark plug orientation is unimportant with respect to combustion behavior. However, in internal combustion engines with direct injection, it was determined that the combustion behavior of a combustion chamber can vary depending on the spark plug orientation.

At least one object of the present invention is to provide a spark plug and cylinder head for an internal combustion engine with direct injection to ensure a uniform combustion behavior by all cylinders in the internal combustion engine. In addition, other objects, desirable features, and characteristics will become apparent from the subsequent summary and detailed description and the appended claims, taken in conjunction with the accompanying drawings and this background.

SUMMARY

The at least one object is achieved on the one hand by virtue of the fact that, given a spark plug with an external thread and a spark plug body that carries electrodes that border at least one spark gap at one end, the spark plug body exhibits a rotational coding, and the external thread is formed on a nut that can rotate around the spark plug body.

The at least one object is achieved on the other hand by virtue of the fact that, given a cylinder head for an internal combustion engine with a fuel injection hole and fixture for a spark plug, the fixture exhibits a rotational coding complementary to the rotational coding of the spark plug.

The spark plug according to an embodiment of the invention can only be used in the cylinder head in an orientation prescribed by the complementary rotational codings. The spark plug is fixed in place using the nut with an external thread, which can be screwed into the fixture of the cylinder head so as to secure the spark plug without turning the spark plug body in the process.

While the fuel aspirated into a cylinder along with fresh air in conventional internal combustion engines is essentially evaporated once it reaches the electrodes of the spark plug and flows uniformly around them, the spatial proximity of fuel injection hole and spark plug in an internal combustion engine with direct injection creates the problem that the fuel reaches the electrodes while still in droplet form. The droplets move essentially along a straight line, so that the electrodes of a conventional spark plug can shadow the spark gap more or less strongly depending on orientation. Because the established orientation of the spark plug relative to the cylinder body, the fuel distribution at the spark gap is identical for all cylinders, thus making the combustion behavior of the engine uniform.

A flange that limits axial mobility of the nut is preferably arranged on the spark plug body between the nut and tip carrying the electrodes. A surface of this flange facing away from the nut can simultaneously act as the sealing face between the spark plug and cylinder head.

This surface can be flat and conical, so as to yield a reliable metal-on-metal seal in direct contact with a seat of the cylinder head, if needed. Of course, a packing ring can alternatively be provided between the mentioned surface and the seat of the cylinder head as well.

The coding can best be established at one edge of the flange. For example, it can take the form of a projecting pin, a notch or a circular segment cut out of the otherwise spherical flange.

The axial freedom of motion of the nut on the spark plug body is best limited in two directions, so that the nut on the spark plug body cannot be lost.

The complementary rotational codings of the spark plug and cylinder head are preferably arranged in such a way that, if the known spark plug exhibits a high-potential electrode and a ground electrode extending like a hook from a root on the spark plug body over the high-potential electrode, the spark plug in the cylinder head can only be mounted in an orientation where the root of the ground electrode and fuel injection hole lie on different sides of the high-potential electrode. This prevents the spark gap from being shadowed by the ground electrode.

BRIEF DESCRIPTION OF THE DRAWINGS

The present invention will hereinafter be described in conjunction with the following drawings figures, wherein like numerals denote like elements.

DETAILED DESCRIPTION

The following detailed description is merely exemplary in nature and is not intended to limit application and uses. Furthermore, there is no intention to be bound by any theory presented in the preceding summary background or the following detailed description.

Figure 1:
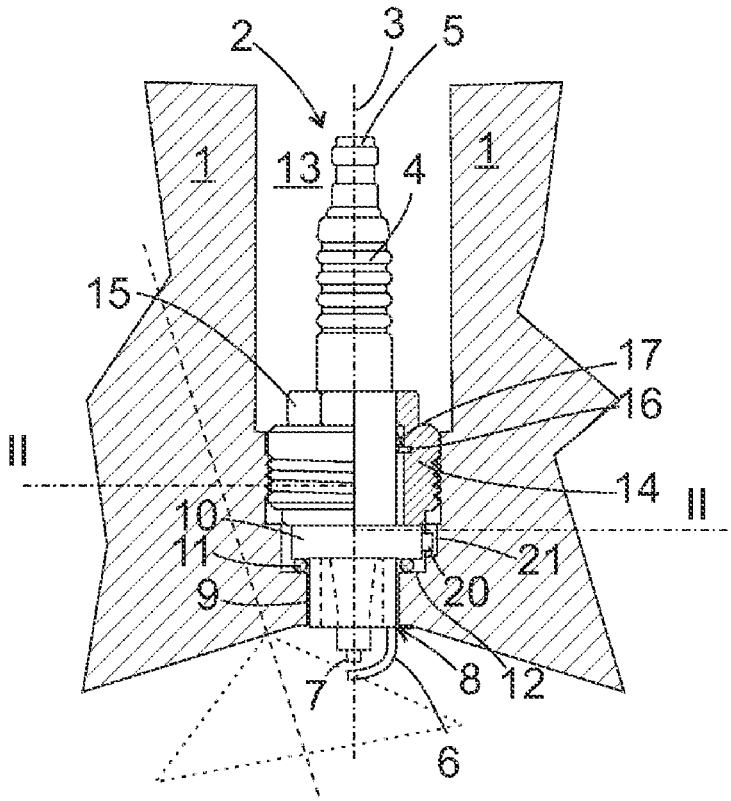
FIG. 1 is an axial section through a spark plug mounted in a cylinder head according to an embodiment of the present invention.

FIG. 1 shows a section of a cylinder head 1 and a spark plug 2 according to an embodiment of the present invention, partially cut along a longitudinal axis 3 of the spark plug 2. The spark plug 2 has a known long stretched-out body 4, whose one end carries a plug-in contact to connect an ignition voltage supply plug (not shown), and whose other end carries a ground electrode 6 and a high-voltage electrode connected with the plug-in contact 5 by a conductor running along the axis 3. The ground electrode 6 is shaped like a hook, with a free end opposite the high-voltage electrode 7 on the axis 3, and a root 8 extending from a metallic sheath 9 of the spark plug body 4 coaxial to the longitudinal axis 3. The ground electrode 6 is galvanically connected via the sheath 9 with an essentially spherical flange 10.

A packing ring 11 is clamped between the lower side of the horizontally oriented (on FIG. 1) flange 10 and a seat 12 of a borehole 13 of the cylinder head 1 that receives the spark plug 2.

It is also conceivable to omit the packing ring 11 and have the flange 10 form a seal directly on the seat 12, in particular if the cylinder head 1 consists of an aluminum alloy, and the flange 10 consists of steel, for example. In this case, the lower side of the flange 10 is advantageously flat and conical, so as to generate a sealing line directly along an inner edge of the seat 12.

The flange 10 is pressed against the seat 12 by a nut 14 with external thread, which engages the internal thread of the borehole 13. The nut 14 can be rotated freely around the longitudinal axis 3 against the body 4 of the spark plug, so that the nut 14 can be screwed in and out of the borehole 13 using a tool (not shown) that grips the hexagon insert bit section 15 of the nut, without turning the body 4 in the process.

The nut 14 can be a component independent of the spark plug body, which during the incorporation of the spark plug 2 via the spark plug body is overlapped by its upper end, and can be detached from the body 4 once more during disassembly; it is also conceivable to anchor the nut 14 to the body 4 so that it cannot be lost. For example, this can be achieved as shown on FIG. 1 by means of a snap ring 16, which is accommodated in a groove open toward the inner cavity of the nut 14, and negotiates one or more flexibly insertable latching lugs 17 of the cylinder body 4 as the nut 14 is plugged onto the body 4.

Figure 2:
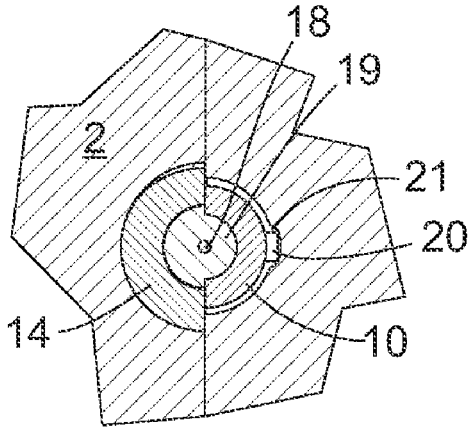
FIG. 2 is a section through the spark gap and the cylinder head in a section along the plane designated II-II on FIG. 1.

FIG. 2 shows a section through the cylinder head 1 and spark plug 2 along the line denoted with II on FIG. 1. Visible in the middle of the section is the plug-in contact with the conductor 18 that connects the high-voltage electrode 7, enveloped by an insulating body 19. The nut 14 can be discerned in the left half of the figure around the entire insulating body 19; the flange 10 is shown in the right half. A coding lug 20 projects from the flange 10, positively engaging an axially parallel groove 21 of the cylinder head borehole 13, and thereby establishing a rotational orientation in which only the spark plug 2 can be mounted in the cylinder head borehole 13.

Referring once again to FIG. 1, the progression of a fuel injection borehole through the cylinder head 1 is denoted by a dashed line 22, and a fuel atomizing cone is depicted on FIG. 1 as a triangle with a stippled outline. An injection hole 23, the high-voltage electrode 7 and roots 8 of the ground electrode 6 all lie in the sectional plane of FIG. 1, wherein the high-voltage electrode 7 is located between the two other elements 23, 8. The spark gap bordered by the two electrodes 6, 7 hence is open relative to the injection hole 23, meaning that fuel droplets emanating from that location are not prevented by the hook-shaped ground electrode 6 from reaching the spark gap.

It is not necessary for the injection hole 23 and root 8 be diametrically opposed relative to the axis 3 to avoid shadowing the spark gap. Therefore, the groove 21 can be distinctly wider than the coding lug 20 of the spark plug body 4, so that the latter exhibits a certain freedom of movement around the axis 3. It is also conceivable to provide several grooves 21, into which the coding lug 20 can optionally be introduced, e.g., two grooves 21 that each establish mirror-image positions of the spark plug body 4 relative to a plane running through the axis 3 and injection hole 22.

The previously described spark plug is not limited to a spark plug with the electrode arrangement described above, but rather can also be applied with respect to spark plugs with more than two electrodes and/or several spark gaps.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A spark plug, comprising:
- a spark plug body having a first end;
- a rotational coding exhibited on the spark plug body;
- a nut adapted to rotate around the spark plug body;
- an external thread formed on the nut;
- at least two electrodes carried by the first end and bordering a spark gap, and
- a flange that limits an axial freedom of movement of the nut arranged on the spark plug body between the nut and a tip carrying the at least two electrodes.

2. The spark plug according to claim 1, wherein a surface of the flange facing the tip carrying the at least two electrodes is flat and conical.

3. The spark plug according to claim 1, wherein the rotational coding is formed on an edge of the flange.

4. The spark plug according to claim 1, wherein the axial freedom of movement of the nut is limited on the spark plug body in two directions.

5. A cylinder head for an internal combustion engine, comprising:
- a spark plug, comprising:
  - a spark plug body having a first end;
  - a rotational coding exhibited on the spark plug body;
  - a nut adapted to rotate around the spark plug body;
  - an external thread formed on the nut;
  - at least two electrodes carried by the first end and bordering a spark gap; and
  - a flange that limits an axial freedom of movement of the nut arranged on the spark plug body between the nut and a tip carrying the at least two electrodes; and
- a fixture adapted to receive the spark plug; and
- a second rotation coding exhibited on the fixture that is complementary to the rotational coding of the spark plug.

6. The cylinder head according to claim 5, further comprising:
- a high-potential electrode; and
- a ground electrode extending from a root on the spark plug body over the high-potential electrode,
- wherein the rotational coding and the second rotation coding only permit assembly of the spark plug in an orientation where the root and a fuel injection hole lie on different sides of the high-potential electrode.

7. The cylinder head according to claim 6, wherein the ground electrode is a hook.

8. The cylinder head according to claim 6, wherein a surface of the flange facing the tip carrying the at least two electrodes is flat and conical.

9. The cylinder head according to claim 6, wherein the rotational coding is formed on an edge of the flange.

10. The cylinder head according to claim 6, wherein the axial freedom of movement of the nut is limited on the spark plug body in two directions.

* * * * *